United States Patent [19]

Difflipp et al.

[11] Patent Number: 4,527,478

[45] Date of Patent: Jul. 9, 1985

[54] MEANS FOR CLAMPING GRAVURE PLATES

[75] Inventors: Kurt Difflipp, Dietzenbach; Henrich Ochs, Oberzell, both of Fed. Rep. of Germany

[73] Assignee: M.A.N.-Roland Druckmaschinen Aktiengesellschaft, Fed. Rep. of Germany

[21] Appl. No.: 563,649

[22] Filed: Dec. 20, 1983

Related U.S. Application Data

[63] Continuation-in-part of Ser. No. 493,734, May 11, 1983, abandoned.

[51] Int. Cl.[3] ..... B41F 21/00

[52] U.S. Cl. ..... 101/415.1

[58] Field of Search ..... 101/415.1

[56] References Cited

U.S. PATENT DOCUMENTS

| | | | |
|---|---|---|---|
| 919,665 | 4/1909 | Whatley | 101/415.1 |
| 2,157,621 | 5/1939 | Neilson | 101/415.1 |
| 2,194,424 | 3/1940 | Grupe | 101/415.1 |
| 2,946,282 | 7/1960 | Harless | 101/415.1 |
| 3,166,012 | 1/1965 | Hantscho | 101/415.1 |
| 4,100,854 | 7/1978 | Fujishiro et al. | 101/415.1 |
| 4,104,968 | 8/1978 | Schwaab et al. | 101/415.1 |

FOREIGN PATENT DOCUMENTS

| | | | |
|---|---|---|---|
| 2235119 | 2/1973 | Fed. Rep. of Germany | 101/415.1 |
| 2092956 | 8/1982 | United Kingdom | 101/415.1 |

*Primary Examiner*—Paul T. Sewell
*Assistant Examiner*—John A. Weresh
*Attorney, Agent, or Firm*—Leydig, Voit, Osann, Mayer & Holt, Ltd.

[57] ABSTRACT

In accordance with the invention, a plate-clamping mechanism is provided for clamping and locking flexible printing plates on a printing cylinder wherein a clamping jaw fitted into a cylinder cavity has a leading edge for clamping one end of printing plate which is (1) non-parallel to the cylinder's axis of rotation and (2) coincident with the periphery of the cylinder when the clamping jaw is in its opened or closed position. In addition, the clamping jaw's axis of rotation is parallel to the jaw's leading edge. Such a clamping jaw eliminates any void between the printing plate and the cylinder surface which might otherwise exist after the plate is tensioned and clamped: such a void is common in printing cylinders with clamping jaws having leading edges non-parallel to the cylinder's axis of rotation.

6 Claims, 3 Drawing Figures

MEANS FOR CLAMPING GRAVURE PLATES

This is a continuation in part application of U.S. application Ser. No. 06/493,734 filed 5-11-83 now abandoned.

TECHNICAL FIELD OF THE INVENTION

The invention relates to sheet gravure presses and, more particularly, to means for clamping a gravure plate to a rotary printing cylinder.

BACKGROUND OF THE INVENTION

Mechanisms for clamping gravure plates are well known. Illustrative of this is German Offenlegungsschrift No. 2,804,304 which discloses toggle levers to actuate a plate-clamping mechanism. Also illustrative of prior art plate-clamping mechanisms is U.S. Pat. No. 2,157,621 to Neilson which discloses a printing cylinder having a peripheral cavity forming a channel along the cylinder's longitudinal length. In the cavity, a cylindrical bearing having an edge portion to receive one end of a printing plate is rotated so as to tension and clamp the printing plate onto the printing cylinder. However, the Neilson mechanism is unsuitable for clamping plates of different thicknesses or for use in connection with an inclined cylinder cavity (i.e., the longitudinal axis of the cavity skewed from the cylinder's axis of rotation).

Traditionally, in a plate-clamping mechanism with an inclined cylinder cavity, the mechanism's axis of rotation is parallel to the cylinder's axis of rotation. Accordingly, the plate-clamping mechanism, when opened and considered over its length, projects from the cylinder cavity and above the cylinder surface on one side while remaining below the cylinder surface on the opposite side. Because of this prior art arrangement, it is often difficult to clamp the printing plate to the cylinder without leaving a gap between the plate's end and the cylinder's surface. This is especially a problem for plates of significant thickness and reduced flexibility.

SUMMARY OF THE INVENTION

It is the primary object of this invention to provide a plate-clamping mechanism for a printing cylinder which, although extending at an angle relative to the cylinder's axis of rotation, smoothly tensions and clamps the plate onto the surface of the cylinder without leaving a gap or void between the plate and the cylinder's surface. In this connection, it is a related object of this invention to provide a plate-clamping mechanism which, when in its closed position, nowhere leaves the printing plate resting on a void along the cylinder periphery.

It is a further object of the invention to provide a plate-clamping mechanism which achieves the foregoing objectives and also successfully secures plates within a predetermined thickness tolerance.

Other objects and advantages of the invention will become apparent from the following detailed description and the accompanying drawings.

In accordance with the invention, a plate-clamping mechanism for clamping and locking flexible printing plates on a printing cylinder is disposed in a cylinder cavity and has a leading edge for clamping one end of printing plate; wherein the leading edge is (1) non-parallel to the cylinder's axis of rotation and (2) coincident with the periphery of the cylinder when the plate-clamping mechanism is in its opened or closed position.

In addition, the plate-clamping mechanism's axis of rotation is parallel to the mechanism's leading edge. Such a plate-clamping mechanism eliminates any void between the printing plate and the cylinder surface which might otherwise exist after the plate is tensioned and clamped: such a void is common in printing cylinders with clamping jaws having leading edges non-parallel to the cylinder's axis of rotation.

While the invention will be described in connected with certain preferred embodiments, it will be understood that it is not intended to limit the invention to those particular embodiments. On the contrary, it is intended to cover all alternatives, modifications and equivalents as may be included within the spirit and scope of the invention as defined by the appended claims.

DETAILED DESCRIPTION OF THE PREFERRED EMBODIMENT

Figure 1:
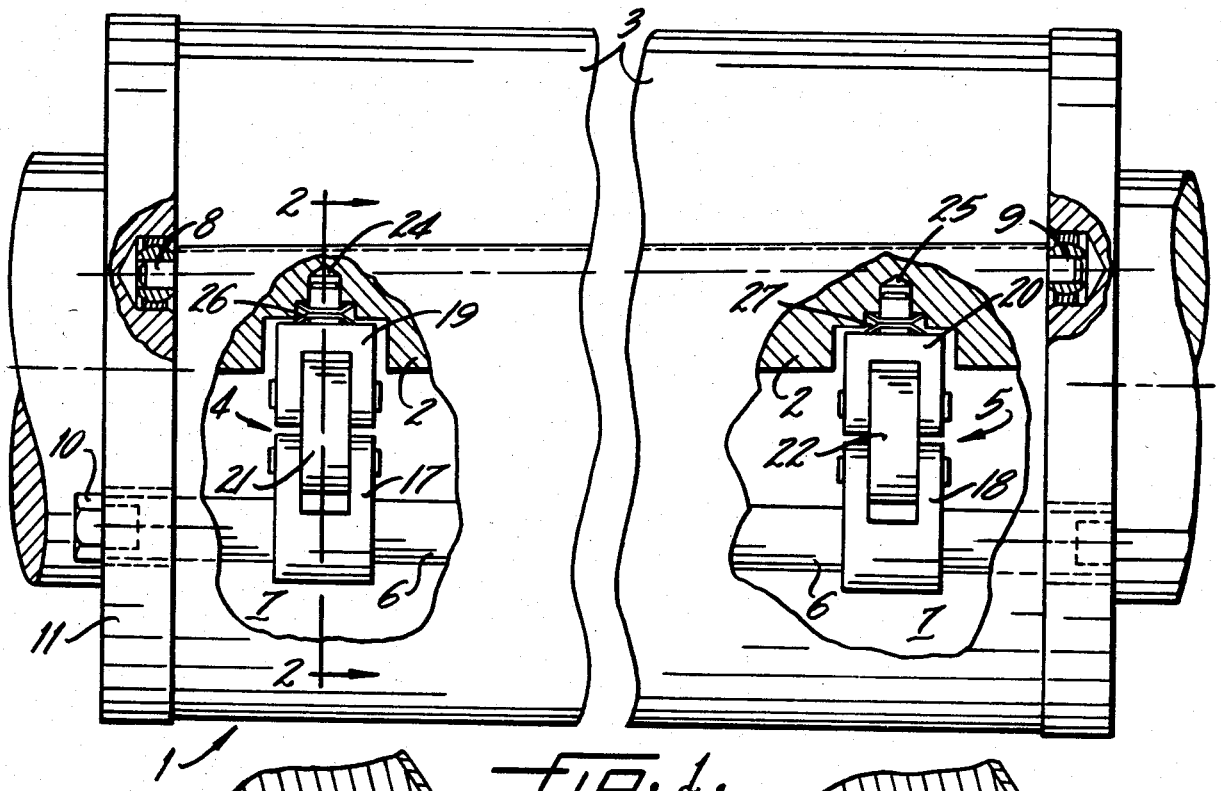
FIG. 1 is a plan view of the printing cylinder and associated plate-clamping mechanism according to the invention with part of the cylinder surface broken away to expose the plate-clamping mechanism retained below the cylinder surface.

Turning now to the drawings and referring first to FIG. 1, a clamping jaw 2 extending longitudinally along the surface of a printing cylinder 1 secures a flexible printing plate 3 onto the cylinder's surface. The clamping jaw 2 is operatively coupled to a shaft 6 by way of linkages 4 and 5. The shaft 6 traverses the longitudinal distance of the cylinder 1 at a radial distance from the cylinder's axis of rotation that is less than the radius of the cylinder 1. Therefore, the shaft 6, the linkages 4 and 5 and the clamping jaw 2 are disposed in a channel cavity 7 formed in the cylinder 1 and extending longitudinally along the length of the cylinder.

In order to open and close the clamping jaw 2 so as to release and capture the printing plate 3, the jaw 2 is mounted for rotation about pivot bearings 8 and 9. A hexagonal nut 10 is operatively coupled to the shaft 6 through a cylinder side wall 11 so as to rotate the shaft. Shaft 6 is mounted for rotation substantially parallel to the printing cylinder's axis of rotation.

Figure 2:
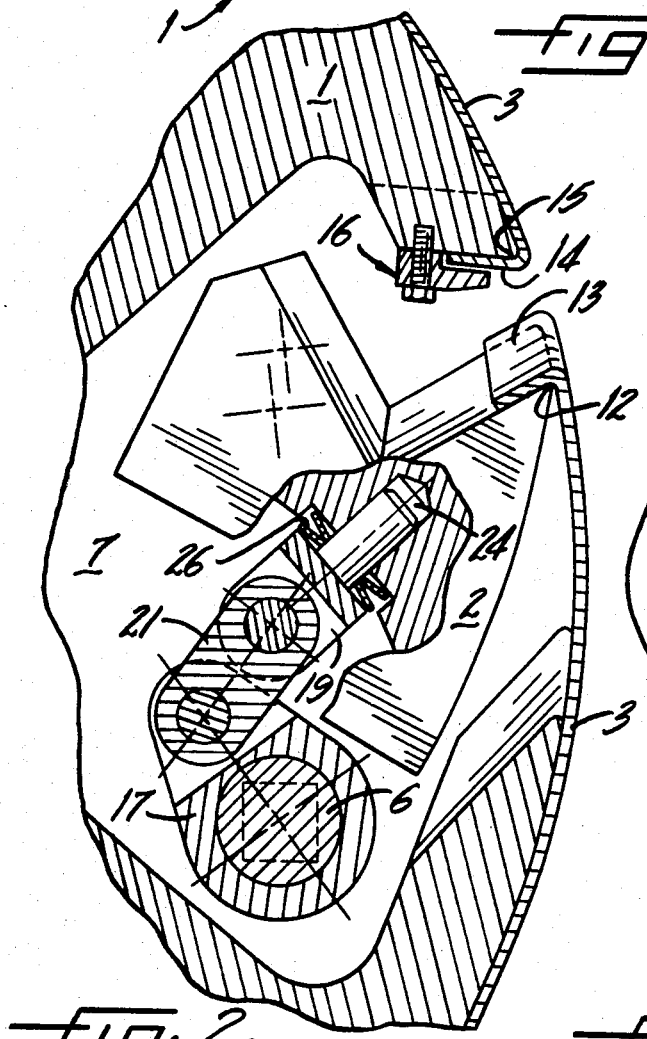
FIG. 2 is an enlarged cross-section of the cylinder in FIG. 1 taken along the line 2—2 showing the plate-clamping mechanism in its opened position.

Referring now to FIG. 2, the clamping jaw 2 receives at its leading edge 12 a first and end 13 of the flexible printing plate 3. The second end 14 of the printing plate 3 is bent around an edge 15 of the cylinder 1 formed by the cylinder cavity 7. A bar and securing-screw assembly 16 may be used to secure the printing plate's end 14 to the cylinder's edge 15. In a similar manner, a like assembly may be used to secure plate end 13 to the clamping jaw's leading edge 12.

After the printing plate 3 has been placed over the cylinder 1 and its two ends connected to the cylinder edge 15 and jaw edge 12, and while the plate-clamping jaw is in its opened position as shown in FIG. 2, the hexagonal nut 10 is turned so as to cause the shaft 6 to rotate and turn a pair of crank levers 17 and 18 in a clockwise direction (FIG. 2). As the crank levers 17 and 18 rotate, they move a pair of pin assemblies 19 and 20 respectively by way of the interconnecting links 21 and 22: in particular, the interconnecting links are pivotally joined to the crank levers 17 and 18 at their first ends and the pin assemblies 19 and 20 at their second ends. Since the heads of pin assemblies 19 and 20 are received in bores 24 and 25 of the clamping jaw 2, movement of the pin assemblies 19 and 20 causes the jaw to rotate about its axis in a counterclockwise direction (as seen in FIG. 2). In so doing, the jaw 2 tensions the printing plate 3 around the surface of the cylinder 1. As rotation of the jaw 2 continues, the jaw edge 12 brings the plate end 13 into contact with the plate end 14 which is held to cylinder edge 15.

Figure 3:
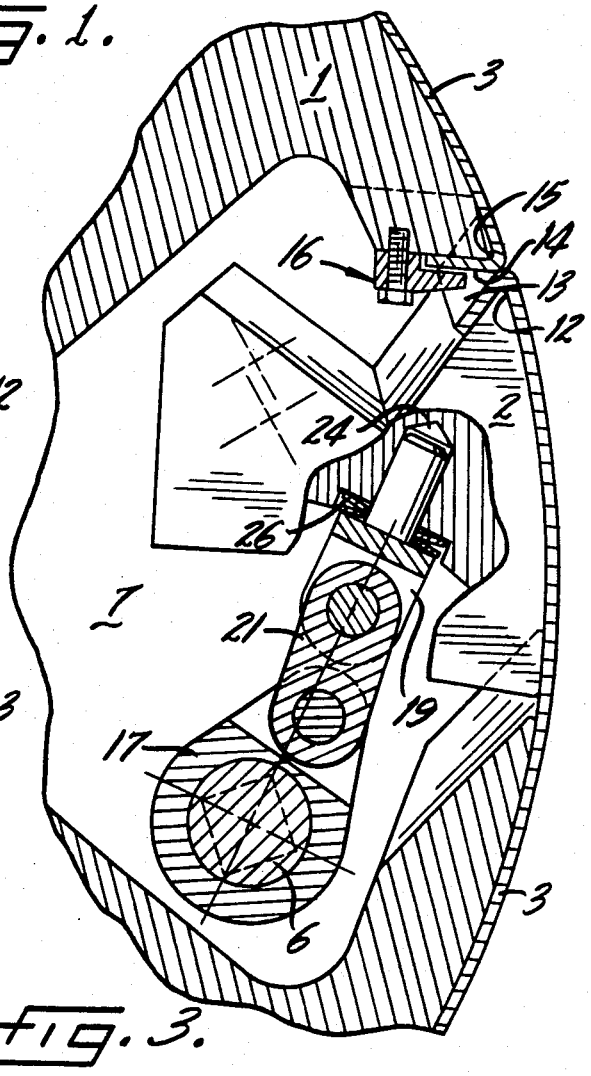
FIG. 3 is an enlarged cross-section of the cylinder in FIG. 1 taken along the line 2—2 showing the plate-clamping mechanism in its closed position.

After the clamping jaw 2 and printing plate's end 13 are rotated into clamping engagement with the cylinder edge 15 and the printing plate's end 14, further rotation of the crank levers 17 and 18 compresses the cup springs 26 and 27 until the crank levers reach their full clockwise rotation which toggles the linkages 4 and 5 into a locked position; thus the clamping jaw 2 is secured in its closed or clamped position illustrated in FIG. 3. By allowing the relative movement of the heads of the pin assemblies 19 and 20 in the clamping jaw's bores 24 and 25 to compress the springs 26 and 27, the clamping jaw 2 may satisfactorily secure in tension a plurality of different plates; wherein the plates are within a predetermined thickness tolerance as determined by the allowable stroke of the heads of pin assemblies 19 and 20 in bores 24 and 25.

In accordance with one important aspect of the invention, the axis of rotation of the clamping jaw 2 is parallel to the straight line formed by cylinder edge 15 such that, in its open or closed position, the clamping jaw edge 12 is coincident with the curved surface formed by the continuation of the cylinder's cylindrical surface over the cylinder opening formed by the cavity 7. Because of the parallel alignment of the clamping jaw's axis of rotation with the cylinder edge 15, the entire length of jaw edge 12 is positioned coincident to the continuation of the cylinder's surface over the cavity 7 both in the jaw's opened and closed position. By so providing, the closing of the jaw 2 smoothly tensions and clamps the plate 3 without leaving a void between the surface of the cylinder 1 and the flexible printing plate.

From the foregoing it will be appreciated that the invention provides an improved plate-clamping mechanism for a printing cylinder which securely tensions and clamps printing plates within a predetermined thickness tolerance while ensuring a significant void does not exist between the cylinder's surface and the plate. By spring biasing the linkages 4 and 5 against the clamping jaw 2, the linkages may be toggled into a locked position while the springs 26 and 27 absorb any relative displacement of the clamping jaw caused by variation in plate thickness; of course, the compressed cup springs have sufficient resilient strength to impose a force on the clamping jaw 2 which firmly clamps the opposing ends of the printing plate to the cylinder 1 when the plate-clamping mechanism is in its closed position.

We claim:

1. In a printing cylinder of a rotary press, comprising, a plate-clamping mechanism for tensioning and clamping a flexible printing plate on the printing cylinder, said plate-clamping mechanism being disposed in a peripheral cavity of said cylinder which extends along the length of said cylinder, said cavity defining an edge which traverses the length of the cylinder along a path non-parallel with the axis of rotation of said cylinder and about which a first end of said flexible printing plate may be positioned and secured;

a clamping jaw disposed in said cavity for rotation about an axis parallel to said cavity edge;

means for pivoting said clamping jaw between a first plate clamping position and a second plate releasing position so as to allow printing plates to be secured on said printing cylinder when in said first clamping position and freed from said printing cylinder when in said second releasing position;

said clamping jaw having a leading edge for gripping the second end of said flexible printing plate, means for mounting said clamping jaw for pivotal movement such that the leading edge thereof extends along the entire length of the said cavity and is substantially coincident along its entire length with the curved surface formed by the continuation of the cylinder surface over said cavity when said clamping jaw is in both said first clamping position and said second releasing position so as to prevent creation of a void between the cylinder surface and the printing plate when said clamping jaw is moved to said first clamping position to tension and clamp said flexible printing plate on said printing cylinder, means including toggle linkage for pivoting said clamping jaw between said first and second positions, spring means interposed between said clamping jaw and said toggle linkage said spring means being compressed between said clamping jaw and said toggle linkage when said jaw is moved to said first clamping position, the compression of said spring means being released to a state of substantially no compression when said clamping jaw is moved to said second position said toggle linkage being moved into a locked position when said clamping jaw is moved to said first position with said spring means biasing said clamping jaw in printing plate clamping condition while accommodating printing plates within a predetermined thickness tolerance.

2. In a printing cylinder as set forth in claim 1 wherein said means for pivoting includes a shaft mounted for rotation about an axis parallel to the axis of rotation of said cylinder.

3. In the printing cylinder as set forth in claim 2 wherein said toggle linkage includes at least two toggle levers connecting said shaft to said clamping jaw such that full rotation of said shaft in a first direction positions said toggle levers in a locked configuration and said clamping jaw in said first clamping position.

4. In the printing cylinder as set forth in claim 1 wherein both said edge of said cavity and said leading edge of said clamping jaw form straight lines along their lengths.

5. A plate clamping mechanism as set forth in claim 1 in which an end of said toggle linkage is formed with a plurality of guide pins, and said jaw is formed with a plurality of apertures for slidably receiving said guide pins during pivoting of said clamping jaw.

6. A plate clamping mechanism as set forth in claim 5 in which said spring means includes a spring disposed about each guide pin in interposed relation between the end of said toggle linkage and said jaw.

* * * * *